US005279529A

United States Patent [19]

Eschenbach

[11] Patent Number: 5,279,529

[45] Date of Patent: Jan. 18, 1994

[54] PROGRAMMED PEDAL PLATFORM EXERCISE APPARATUS

[76] Inventor: Paul W. Eschenbach, 143 Lakeland Ave., Moore, S.C. 29369

[21] Appl. No.: 869,641

[22] Filed: Apr. 16, 1992

[51] Int. Cl.[5] ..... A63B 22/00; A63B 22/06

[52] U.S. Cl. ..... 482/57; 482/51; 482/52

[58] Field of Search ..... 482/57, 61, 51-; 74/594.4, 594.5, 597; 128/25

[56] References Cited

U.S. PATENT DOCUMENTS

| | | | |
|---|---|---|---|
| 518,757 | 4/1894 | Hoyt | 74/594.4 |
| 1,323,004 | 11/1919 | Boyd | 74/594.4 |
| 2,641,249 | 6/1953 | Brockman | 74/594.4 |
| 4,505,473 | 3/1985 | Pro | 482/61 |
| 4,779,863 | 10/1988 | Yang | 482/57 |
| 4,786,050 | 11/1988 | Geschwender | 482/57 |

FOREIGN PATENT DOCUMENTS

| | | | |
|---|---|---|---|
| 0206208 | 10/1939 | Switzerland | 482/57 |
| 1600816 | 10/1990 | U.S.S.R. | 482/57 |

*Primary Examiner*—Stephen R. Crow

[57] ABSTRACT

An exercise apparatus that simulates uphill cycling where the user is able to maintain a preferred standing posture while programmed pedal platforms supporting each foot move through an exercise cycle that includes translating and non-parallel angular motion generated by a linkage mechanism. Simple harmonic load resistance acting upon the linkage mechanism is provided by drag pulleys or viscous damping cylinders for high intensity cycling exercise without dead center rotary crank problems.

14 Claims, 14 Drawing Sheets

FIG. 1 - PRIOR ART

PROGRAMMED PEDAL PLATFORM EXERCISE APPARATUS

BACKGROUND OF THE INVENTION

1. Field

The present invention relates to an exercise apparatus that simulates uphill bicycling. More particularly, the present invention relates to an exercise apparatus having separately supported pedal platforms exhibiting non-parallel programmed motion in conjunction with the phasing of two or more sources of non-linear load resistance highly suited as an uphill trainer.

2. State of the Art

The benefits of regular exercise to improve overall health, appearance and longevity are well documented in the literature. For exercise enthusiasts the search continues for a safe apparatus that provides maximum benefit in minimum time without boredom.

The sit down exercise cycle is the most commonly used apparatus today to elevate the heart rate and exercise some of the leg muscles. To achieve any significant benefit, however, an extensive amount of time is demanded of the user resulting in boredom. The Lifecycle, U.S. Pat. No. 4,358,105 leads a popular trend to reduce the boredom of sit down cycling by offering programmed load resistance changes over many minutes of cycling and a clever display to capture the attention of the user. However, the issue of extensive time and limited muscle usage is not fully addressed.

To reduce the time for a given benefit, the muscles must be worked harder with increased load. Increasing the load of common resistance systems such as air drag systems U.S. Pat. Nos. 4,789,153; 4,971,316, friction brakes U.S. Pat. Nos. 4,007,927; 4,981,294 or electrical drag U.S. Pat. No. 4,424,021 reduces crank speed making it very difficult for the user to pedal through the dead center positions occurring when the leg is fully extended or retracted during operation. The device described in U.S. Pat. No. 3,360,263 involves an eccentric brake drum which helps reduce top/bottom dead center problems associated with sit-down exercise cycles. Other U.S. Patents dealing with mechanisms or controls to modify the load resistance cycle include U.S. Pat. Nos. 3,419,732; 3,501,142; 3,518,985; 3,744,480; 3,767,195; 3,802,698; 3,845,756; 3,848,467; 4,112,928; 4,244,021 and 4,029,334. However, none of these efforts anticipate the phasing of two or more separate load resistance systems to increase the pedal load on the down or power stroke while decreasing the load during the dead center positions. Still only limited muscles are used during sit-down cycling even with increased loading.

In recent years, stair climbers have become very popular due to the higher loading possible with stand-up exercise as well as different muscles used compared to sitdown cycling. The Stairmaster U.S. Pat. No. 4,708,338 is one of the most popular stairclimbers allowing up and down independent parallel foot pedal movement with programmed load variation over multiple cycles as well as a clever display to hold the attention of the user. Other stairclimbers U.S. Pat. Nos. 4,989,858 and 5,013,031 provide reciprocating foot motion but with non-parallel pedal control and differing load resistance systems.

Another group of stair climbers U.S. Pat. Nos. 4,687,195; 4,726,581 and 4,927,136 have moving stairs requiring the user to remove the foot from each stair after the down stroke. While this foot motion is more diverse than the reciprocating motion of most stair climbers, the issue of operator safety requires complex solutions for practical apparatus.

Stand-up cycling approaches the benefits of running to the cardiovascular system if only uphill cycling could be achieved. Dr. Cooper in his book entitled THE AEROBICS PROGRAM FOR TOTAL WELL-BEING by Dr. Kenneth H. Cooper, Bantam Books, New York, 1982 awards only half the benefit points to sit-down stationary cycling (page 260) over regular cycling which includes an equal amount of uphill and downhill course (page 255). Dr. Cooper grades running some what better than regular cycling, but without the downhill rest inherent in regular cycling, it is certain that uphill cycling only would be superior to running for cardiovascular benefits in less time.

Stand-up cycling is described in various patents such as U.S. Pat. No. 3,563,541 (Sanquist) which uses weighted free pedals as load resistance and side to side twisting motion. Also U.S. Pat. Nos. 4,519,603 and 4,477,072 by DeCloux describe stand-up cycling with free pedals in a lift mode to simulate body lifting after the lower dead center pedal position to the other pedal in the higher position. A brake or clutch system is deployed to load or stop the lower pedal while the weight is transferred to the other pedal after the crank has passed through the dead center position. All of these stand-up cycling patents mentioned use free pedals which are free to rotate about one pivot point on the crank. Stand-up pedaling is safer when the free pedal is fully constrained to become a platform capable of providing body balance on one foot with minimum hand support.

Parallel motion pedal constraint is shown in U.S. Pat. No. 4,643,419 (Hyde) where pulleys of the same size are coupled with a belt or chain to maintain a pedal platform horizontal or parallel to a base through a rotatable cycle of motion. Parallel pedal motion using a parallelogram linkage is shown in U.S. Pat. No. 4,708,338. Another popular stand-up exerciser is sold by Diversified Products of Opelika, Al. as the DP Air Strider shown in FIG. 1. The Air Strider provides a pedal platform constrained by two equal length cranks which are coupled by a chain riding on equal diameter sprockets giving parallel horizontal pedal motion similar to Hyde. While parallel platforms help stabilize the balance of the user, the heel of the foot raises from the platform during operation when the knee is bent in the upper positions of pedal platform movement (see FIG. 1). The ankle ligaments and particularly the Achilles tendon are subjected to excessive stress when the heel is raised forcing all weight on that leg to be supported by the ball of the foot.

There is a need for an exercise cycle that can be used in the stand-up mode that provides a stable pedal platform which inclines as the knee is bent thus obviating the need to raise the heel off the pedal platform whereby unwanted stress is removed from the ankle ligaments and from the Achilles tendon. There is a further need to provide load resistance with high intensity down loading and low intensity dead center loading for stand-up or sit-down cycling to increase the exercise benefit in shorter time intervals.

SUMMARY OF THE INVENTION

The present invention relates to the kinematic motion control of cycling pedal platforms coordinated with varying load resistance during the cycle preformed by the user. More particularly, apparatus is provided that offers high intensity exercise through a leg operated, rotary motion mode of exercise in which the pedal platform supporting each foot is guided through successive non-parallel positions during the rotary cycle while the resistance load acting upon the pedal platform can change with each subsequent position of the pedal platform. The apparatus includes a separate pedal platform for each foot, each partially supported by a rotary crank which normally completes one full revolution during a cycle and is phased approximately 180 degrees relative to the crank for the other pedal platform through a bearing journal attached to the framework. The pedal platforms are not free to rotate but are supported in one embodiment by a secondary crank rotatably attached to the pedal platform and the framework through bearings to form a four-bar linkage known in the literature as a crank-rocker mechanism where the pedal platform is part of the coupler link.

In another embodiment, the secondary crank supporting the pedal platform becomes a slider where the sliding element is pivotally connected to the pedal platform or coupler link and the slider moves in an adjustable linear or curved track attached to the framework. This mechanism is called a slider-crank.

In a further embodiment, the pedal platforms have two rotary cranks for support comprising a five-bar geared linkage with the pedal platform as a part of the coupler link. While suitable for a stationary exercise cycle, the mechanism is shown as the primary drive of a bicycle.

In another embodiment, the user is in the standing position with one or both hands gripping a handlebar such that the hip joint near the center of gravity is directly above or forward of the rotary crank bearing journal as would be the case in riding a bicycle uphill. It is not necessary to elevate the center of gravity of the user during a cycle to enjoy high intensity exercise.

In a still further embodiment, the user is seated while riding the pedal platforms with one or both hands gripping a handlebar.

In one embodiment, a flywheel driven by the rotary crank through chains and sprockets is used to carry the pedal platforms through the dead center positions where conventional load resistance is used such as band friction, air fan, viscous, electrical or magnetic means.

In another embodiment, the load resistance acting upon the rotary crank is supplied by cables attached to each crank pedal platform bearing such that the cable passing over multiple drag pulleys provides a simple harmonic loading. At the dead center positions of the crank, low intensity load is experienced while high intensity loading occurs between the dead center positions. An adjustable spring attached to a movable carriage provides the normal force which is converted into friction bearing drag within each drag pulley. The cable does not slip on the pulleys. As the crank turns, the cable reciprocates over the drag pulleys changing directions of movement near the dead center positions. The carriage containing some of the drag pulleys, reciprocates as the crank rotates such that the load spring is fully extended approximately half way between the dead center positions. The crank pulling the cable through the drag pulleys experiences higher tension while the other end of the cable has low tension approaching a slack condition.

In a further embodiment, a second drag pulley system has cables connected to a bearing fixed to each coupler link containing a pedal platform which provides a second harmonic loading that is phased to peak near the dead center positions while the primary simple harmonic loading peaks approximately half way between the dead center positions. When the primary peak load is chosen to be higher than the secondary peak load, high intensity crank load occurs between dead center positions while low intensity crank torque occurs through the dead center positions with a smooth transition for ease of pedaling. Each drag pulley system is independently adjustable in load intensity for custom user load selection.

In another embodiment, the secondary load resistance is comprised of conventional means of resistance such as air fan, band friction, viscous, electrical or magnetic.

In a still further embodiment, both the primary and secondary load resistance are composed of linear viscous damping where load resistance is proportional to speed. A rotary crank is pivotally attached to a primary damping cylinder which is pivotally attached to a frame. As the crank rotates a simple harmonic load resistance is imposed upon the crank. A second damping cylinder is pivotally attached to the rotary crank to impose a secondary load resistance but phased where the peak load occurs during the minimum load of the primary load resistance. The load crank is driven by a chain or toothed belt and equal diameter sprockets, one attached to the load crank and the second attached to a simple bicycle type crank having free pedals or pedal platforms pivotally attached at approximately 180 degrees apart. Proper selection of damping rates, crank arm length and phasing angle between the primary and secondary load resistance and pedal crank yields an exercise apparatus having a smooth high intensity down stroke load and a low intensity loading through the dead center positions. A simple phase change between the two cranks would allow pedaling in any body position, even prone, without dead center problems.

Another feature of phased simple harmonic load resistance is that two or more systems can be phased to cause a nearly uniform loading throughout the rotary cycle. Selective phasing between systems could be used to increase the high intensity portion of the cycle as well.

It will be appreciated that neither the drag pulley system or the viscous damping load resistance system requires the momentum of a flywheel to carry the pedals through the dead center positions. Therefore, one-way clutches are not needed as a safety feature in this invention to prevent the flywheel motion from driving pedals when the user stops. With phased load resistance, the rotary crank stops almost immediately when the user discontinues the application of foot force. Without one-way clutches, the rotary crank can be driven in the reverse direction to exercise different muscles. It will also be appreciated that the principles of phased load resistance taught here apply equally as well to rotary hand operated crank exercise apparatus.

In summary, the application of positive non-parallel pedal platform position control affords the benefits of a safer stand-up exercise apparatus having low ankle/Achilles tendon stress compared to parallel platform control allowing high intensity loading which is best applied using phased simple harmonic load resistance.

DETAILED DESCRIPTION OF PRIOR ART

Figure 1:
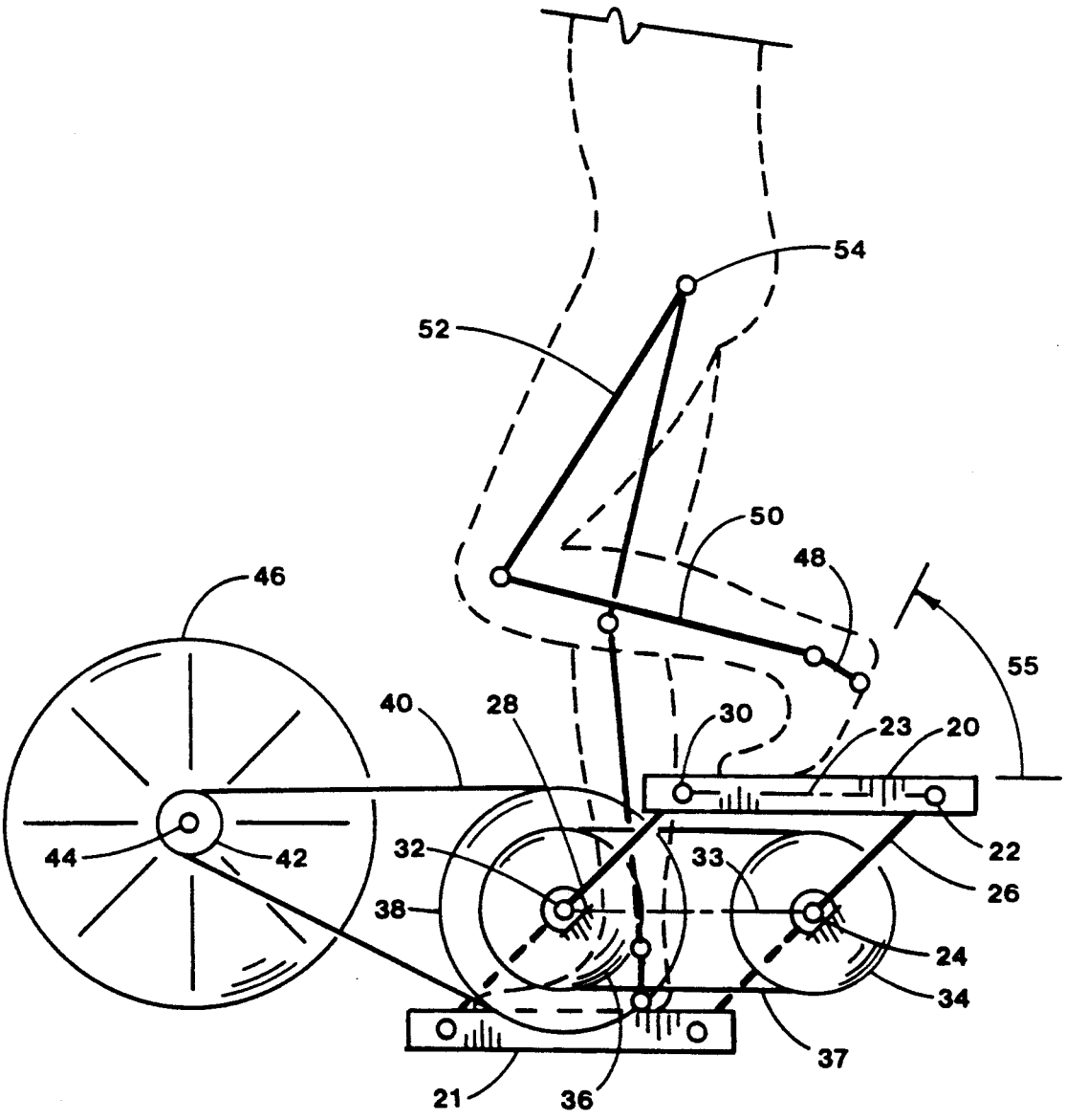
FIG. 1 is a left side elevation view of an example of prior art.

Referring to the drawings in detail, FIG. 1 shows a stand-up exercise apparatus where pedal platforms 20 and 21 support the feet during cycling type exercise. Rotary cranks 26 and 28 are of equal lengths pivotally attached to pedal platform 20 at bearings 22 and 30, and to a framework at pivots 24 and 32. The distance between pivots 22 and 30 is equal to the distance between pivots 24 and 32 such that the four-bar linkage (26,23,28,33) provides parallel motion to pedal platform 20. Pedal platform 21 has the same parallel motion phased 180 degrees apart. Crank journals 24 and 32 are coupled by the equal sprockets 34 and 36 with chain 37. The air fan 46 is driven by chain 40 and sprockets 38 and 42 by crank journal 32. The user is shown where the hip joint 54 experiences very little lifting due to the act of cycling. The right foot is shown firmly planted to the pedal support 21 while the left foot has the heel raised off platform 20 by angle 55, often close to 60 degrees causing stress in the ankle and Achilles tendon.

The stress acting upon the ankle and Achilles tendon could be substantially reduced if line 48 drawn perpendicular to the sole of the foot through the ankle and lower leg segment 50 were to be co-linear during the cycle of exercise, essentially holding the angle 55 to a zero condition. It should be obvious that the balance of the user would be improved to increase user safety.

Many athletes injure the Achilles tendon or ankle ligaments during conditioning exercise or competition. After an ankle ligament sprain or Achilles tendinitis, Dr. William Southmayd in his book SPORTS HEALTH by William Southmayd, M.D. and Marshall Hoffman, Perigee Books, New York, 1982, recommends mild stretching with dorsiflexion to regain motion. There is a need for continued leg exercise with low stress on the injured Achilles tendon and ankle ligaments to regain fitness during the healing process.

DETAILED DESCRIPTION OF THE EMBODIMENTS

Figure 2:
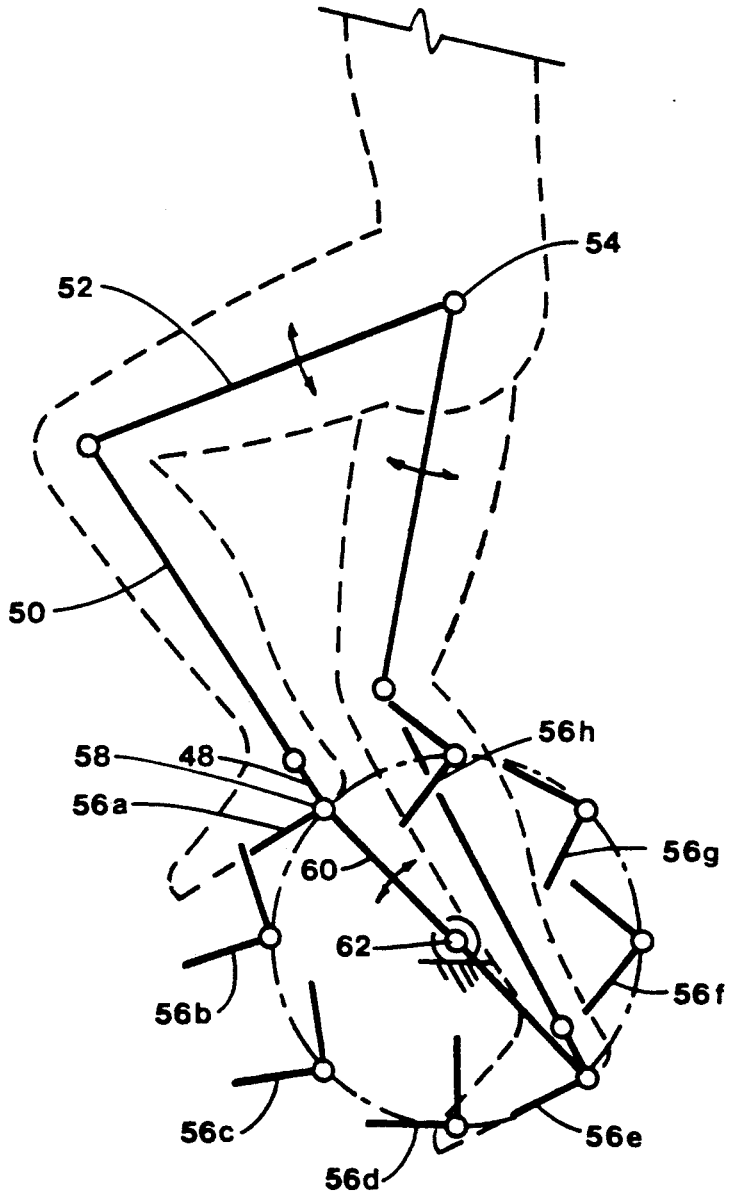
FIG. 2 is a side elevation of the desired foot motion for a rotary crank.

Referring to the drawings in detail, FIG. 2 shows a user in a cycling mode where the hip joint 54 remains nearly stationary acting as a pivot where the upper leg segment 52, lower leg segments 48 and 50 form a four-bar linkage with rotary crank 60 pivotally connected to the foot pedal 56 at bearing 58 and to the frame support (not shown) at 62. If the leg segments 50 and 48 perpendicular to the sole remain co-linear throughout the cycle for low ankle stress, the ideal positions for the pedal are shown as 56*a,b,c,d,e,f,g* and *h*.

It is an object of this invention to synthesize mechanisms that guide pedal platforms through positions similar to the ideal positions shown in FIG. 2. One potential linkage solution would include crank 60, pedal platform 56 attached to a link parallel to leg segment 50 pivotally attached near the knee to a rocker link parallel to leg segment 52 and pivoted adjacent to the hip joint 54. A set of links on either side of the user would provide the proper pedal platform motion control.

Another object of this invention is to reduce the crank torque during the dead center positions which occur when crank 60 is co-linear with leg segments 48 and 50. Top dead center occurs near position 56*a* while bottom dead center occurs near position 56*d* as shown in FIG. 2.

Figure 3:
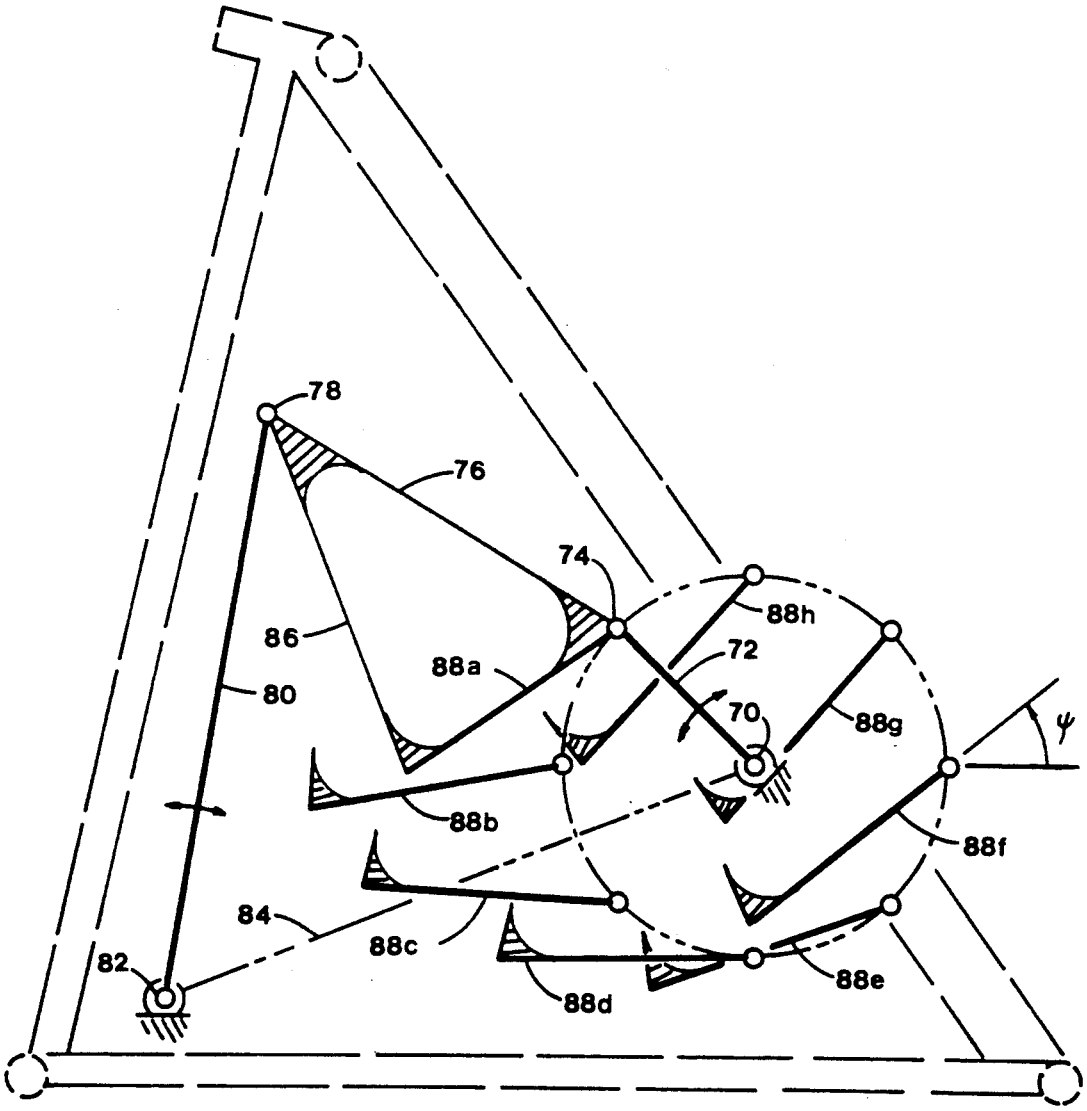
FIG. 3 is a side elevation of the crank and rocker mechanism to produce the desired foot pedal motion.

A preferred mechanism is shown in FIG. 3 where links (72,76,80,84) form a four-bar crank 72 and rocker 80 mechanism. The crank 72 is pivotally attached to the coupler link 76 at bearing 74 and a framework at bearing 70 while the rocker link 80 is pivotally attached to the coupler link 76 at bearing 78 and a framework at bearing 82. As a part of the coupler plane shown as triangle (76,86,88*a*) a pedal platform is defined by triangle side 88*a*. As the crank 72 rotates in a counterclockwise motion, the successive non-parallel pedal platform positions 88*b* through 88*h* are achieved. A comparison of the linkage generated pedal positions of FIG. 3 with the ideal positions of FIG. 2 shows a close approximation.

A dramatic reduction in ankle and Achilles tendon stress is experienced by the user of this programmed pedal platform exercise apparatus. It should be understood, that a clockwise rotation for crank 72 is an option such that a portion of exercise can be clockwise while another part of the exercise can be counterclockwise. Another exercise option is to reciprocate the mechanism where the crank 72 does not complete a full rotation of 360 degrees.

Figure 4:
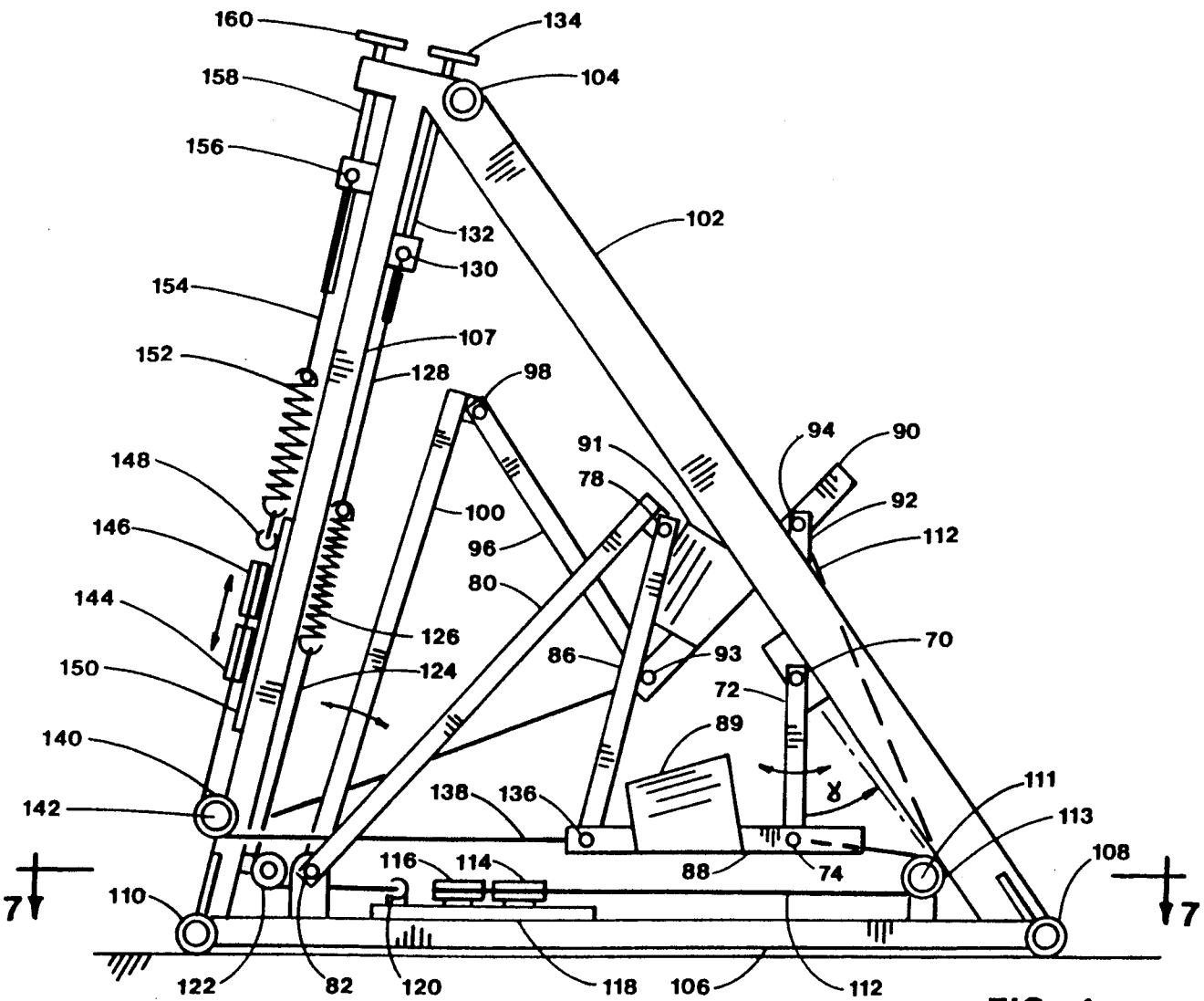
FIG. 4 is a left side elevation for the preferred embodiment of an exercise apparatus constructed in accordance with the present invention.

A preferred embodiment is shown in FIG. 4 which incorporates four-bar linkage (72,76,80,84) of FIG. 3. Rotary crank 72 is pivotally attached to frame 102 by bearing journal 70 also attached to rotary crank 92 which is phased approximately 180 degrees relative to crank 72. A pedal platform 88 is provided for the left foot rotatably connected to crank 72 by bearing 74 while pedal platform 90 is rotatably attached to crank 92 by bearing 94. Coupler lever 86 is rigidly attached to pedal platform 88 by an offset member 136. Coupler lever 96 is similarly offset but attached to pedal platform 90 by member 93. Rocker lever 80 is pivotally connected to coupler lever 86 by bearing 78 and pivotally attached to the framework base 106 by bearing 82. Similarly, rocker lever 100 is pivotally attached to coupler lever 96 by bearing 98 and to the framework base at bearing 82. Both rockers 80 and 100 as well as coupler levers 86 and 96 are close to the center-line of the apparatus seen in FIG. 5 and contained under the tubular frame member 102 as not to interfere with the knee joints during user operation. Foot guards 89 and 91 are provided as a safety feature to prevent any part of the foot from the pinch area occurring when link 72 and pedal platform 88 become parallel. Of course, a raised lip on the pedal platform 88 would serve the same purpose.

Figure 5:
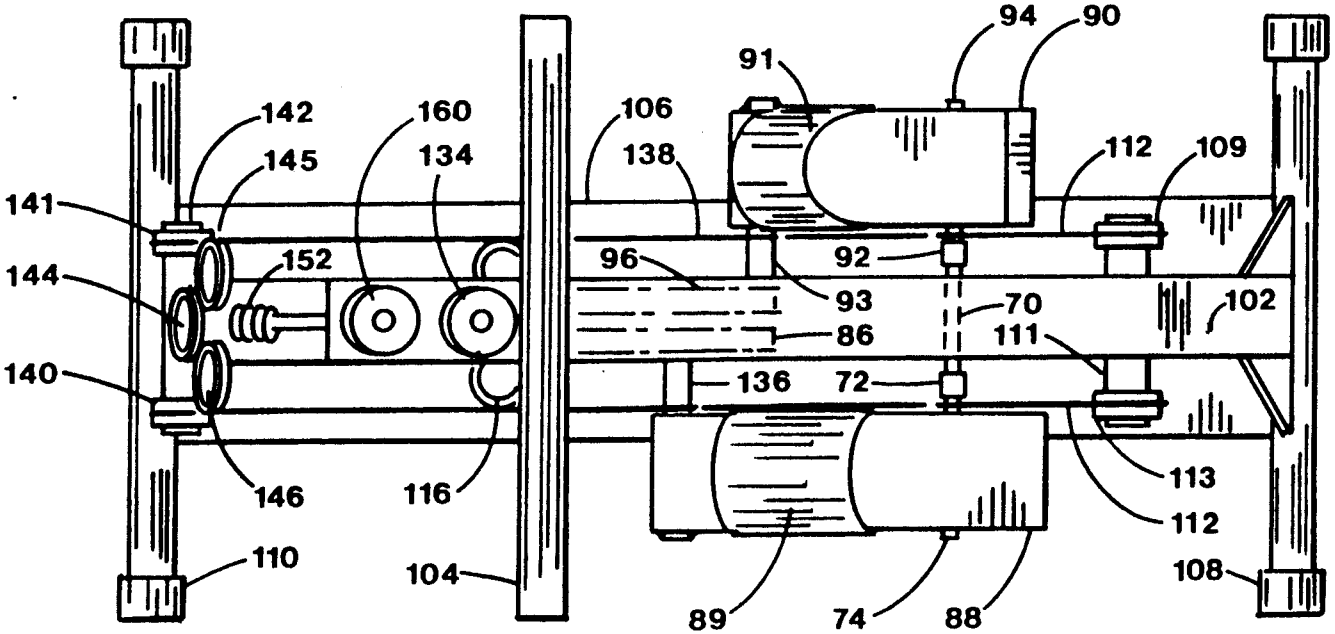
FIG. 5 is a top view of the preferred embodiment shown in FIG. 4.
Figure 6:
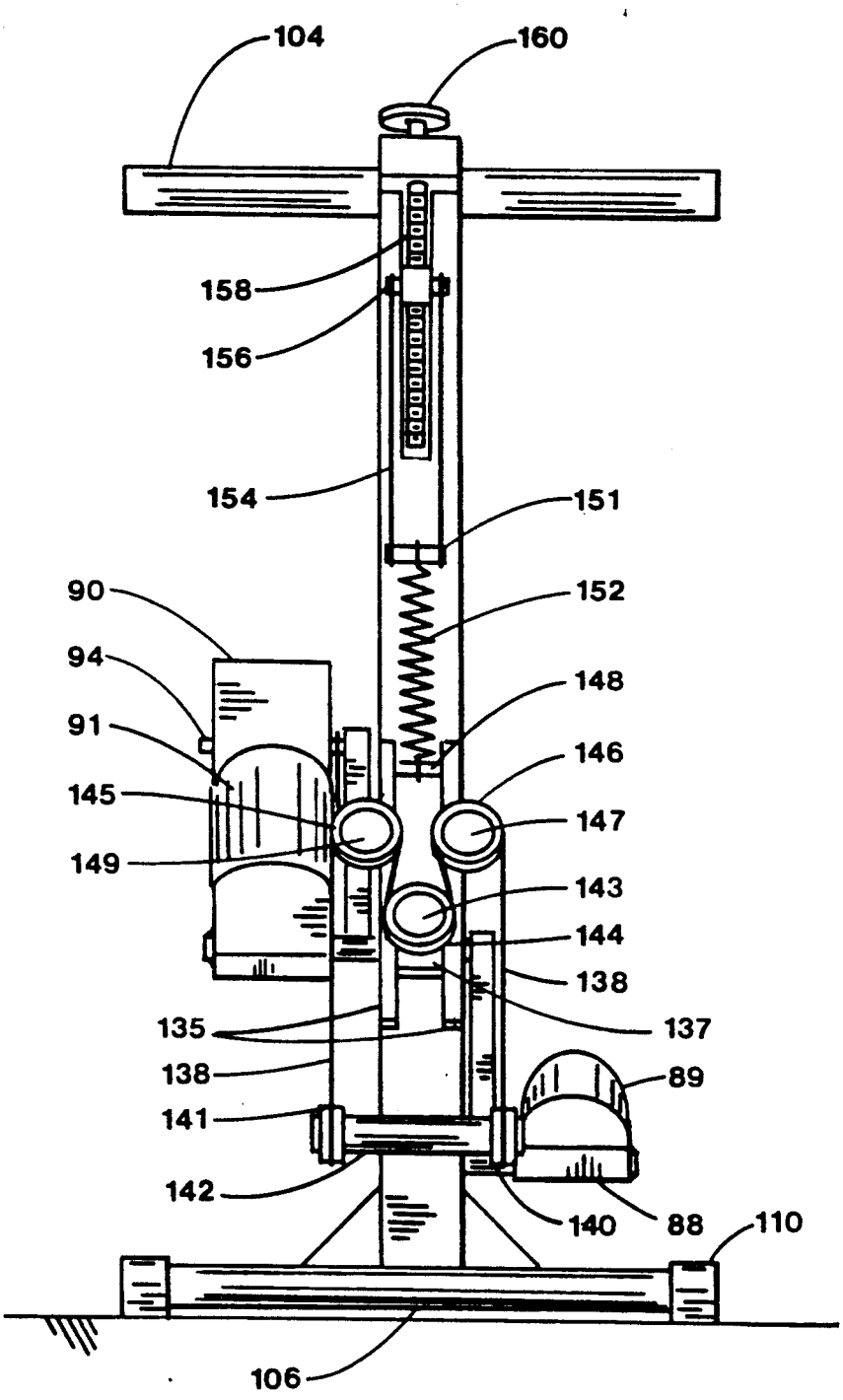
FIG. 6 is a frontal view of the preferred embodiment of FIG. 4.

The framework shown in FIGS. 4,5 and 6 includes a base 106 above and parallel to the room floor supported at the floor by tubular members 108 and 110. Vertical tubular members 102 and 107 are rigidly attached to base 106 and are rigidly joined at their intersection. Hand support 104 can take various curve or straight forms to provide user balance during operation.

A primary load resistance provides torque to the cranks 72 and 92 by virtue of the flexible linking such as cable 112 pivotally attached to bearing journals 74 and 94. Cable 112 is further threaded over drag pulleys (109,115,114,116,113) shown in FIG. 7. A drag pulley is defined here to be a circular, grooved wheel shaped disc to change cable direction and where the disc material is chosen to provide a known friction relative to the shafts (111,117,123,125). Cable 112 does not slip relative to the pulley or disc surface. Tension is added to cable 112 as it passes over each drag pulley due to the bearing friction engineered into the pulley and the normal force provided by the flexible linking.

Figure 7:
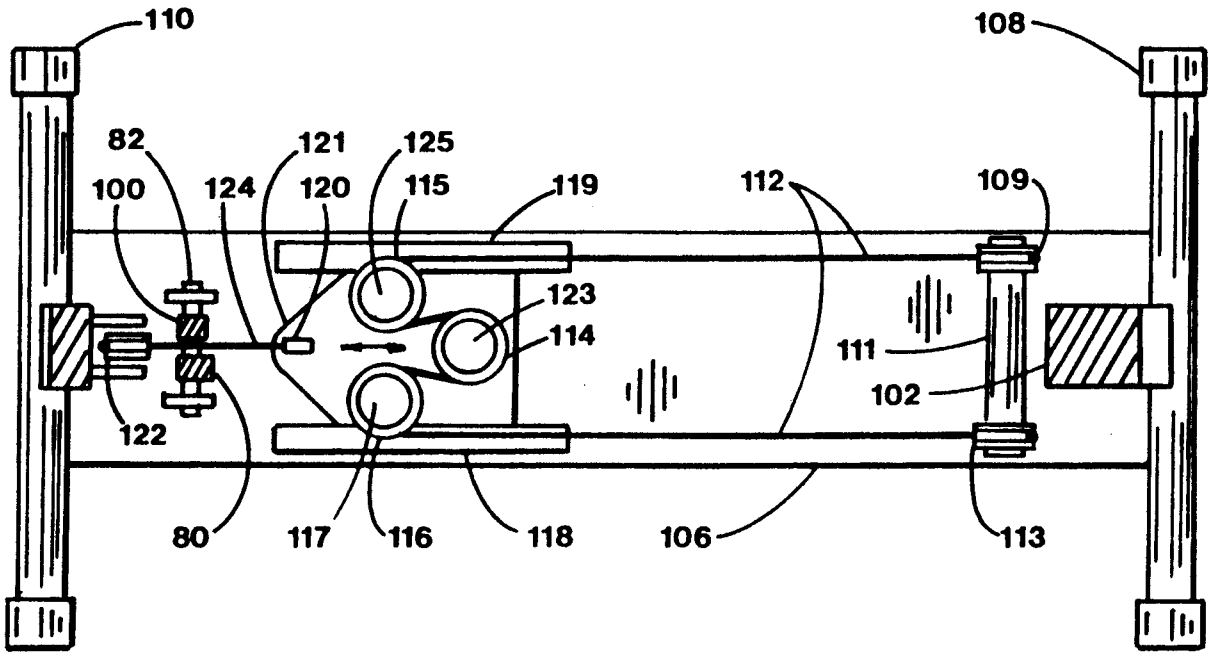
FIG. 7 is a sectional view of the frame base taken along section line 7—7 of FIG. 4.

Drag pulleys 114,115 and 116 shown in FIG. 7 are supported on a movable carriage 121 which is guided by tracks 118 and 119 to slide in a reciprocation mode as the rotary cranks 72 and 92 complete the exercise cycle. Cable 124 is attached to the carriage 121 at the eyelet 120 and primary load spring 126 after turning around pulley 122. Cable 128 connects spring 126 to threaded slide 130. Slide 130 is movable relative to threaded rod 132 as handle 134 is rotated to adjust the spring 126 force acting upon the carriage 121 through cable 124. Of course, other forms of force loading such as free weights or a pressurized cylinder and force variation control can be used to load the carriage 121 with resistance force.

As rotary cranks 72 and 92 rotate, the cable alternately becomes longer or shorter relative to drag pulleys 109, 113 and carriage 121 causing the cable to experience one cycle of direction reversal over the drag pulleys during one full revolution of the cranks. Carriage 121 makes two cycles of reciprocation for one rotation cycle of cranks 72 and 92. Drag pulleys 109 and 113 are rotatably fixed to the framework base 106 by shaft 111 which is offset to the rear of crank journal 70 by angle $\gamma$. The minimum primary load acting upon the cranks 72 and 92 occurs when the cable 112 intersects journal 70. Maximum cable 112 tension occurs when the crank 72 or 92 is at the $\gamma + 90$ degree position. An angle $\gamma > 0$ and close to the dead center position 56*a* of FIG. 2 has been found to give better crank torque properties to simulate uphill cycling.

A secondary drag pulley system acting through cable 138 which is pivotally attached to the coupler planes containing the pedal platforms 88 and 90 at offsets 93 and 136. It is understood that other locations in the coupler planes, rotary or rocker cranks can be chosen to apply the secondary load resistance. Cable 138 passes over drag pulleys (140,146,144,145,141) as best shown in FIG. 6. The drag pulleys 140 and 141 are rotatably supported by shaft 142 which is attached to frame member 107 so as to phase the peak secondary load resistance during the dead center positions of rotary cranks 72 and 92. Dead center positions occur when the leg of the user is fully extended and fully retracted in a bent mode regardless of the user orientation including stand-up, sit-down or prone. Drag pulleys 146, 144 and 145 are grooved discs of a material such as polyethelene rotatably attached to shafts 147,143 and 149 which are mounted on carriage 137. Carriage 137 is constrained by rails 135 to move with a sliding motion parallel to frame 107. It will be understood that one or more swing arms could also constrain the carriage 137. A secondary load spring 152 is attached to carriage 137 at eyelet 148 and to cable 154. Cable 154 is attached to threaded slide 156 which moves parallel to frame member 107 through threaded rod 158 and adjustment handle 160. The secondary load spring 152 is normally of a lower spring constant than primary load spring 126 and has independent adjustment. It is also possible to combine slides 130 and 156 into one adjustment system for both springs. The phased load resistance taught by this invention provides a smoothly varying torque on the rotary cranks 72 and 92 ideally suited for high intensity cycling without dead center difficulties.

Figure 8:
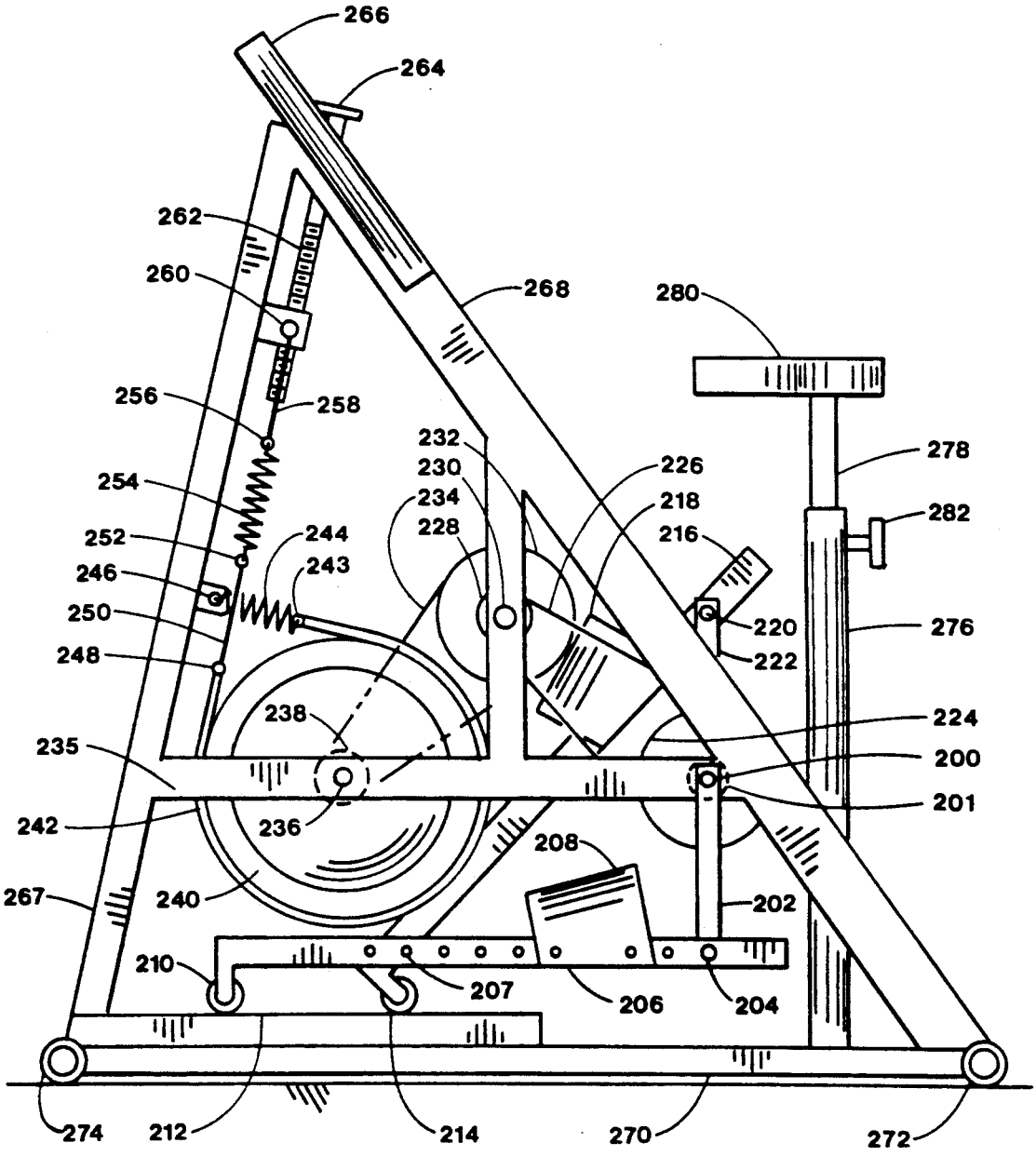
FIG. 8 is a left side view of an alternate embodiment of the present invention that utilizes a slider crank mechanism for foot pedal platform motion control.
Figure 9:
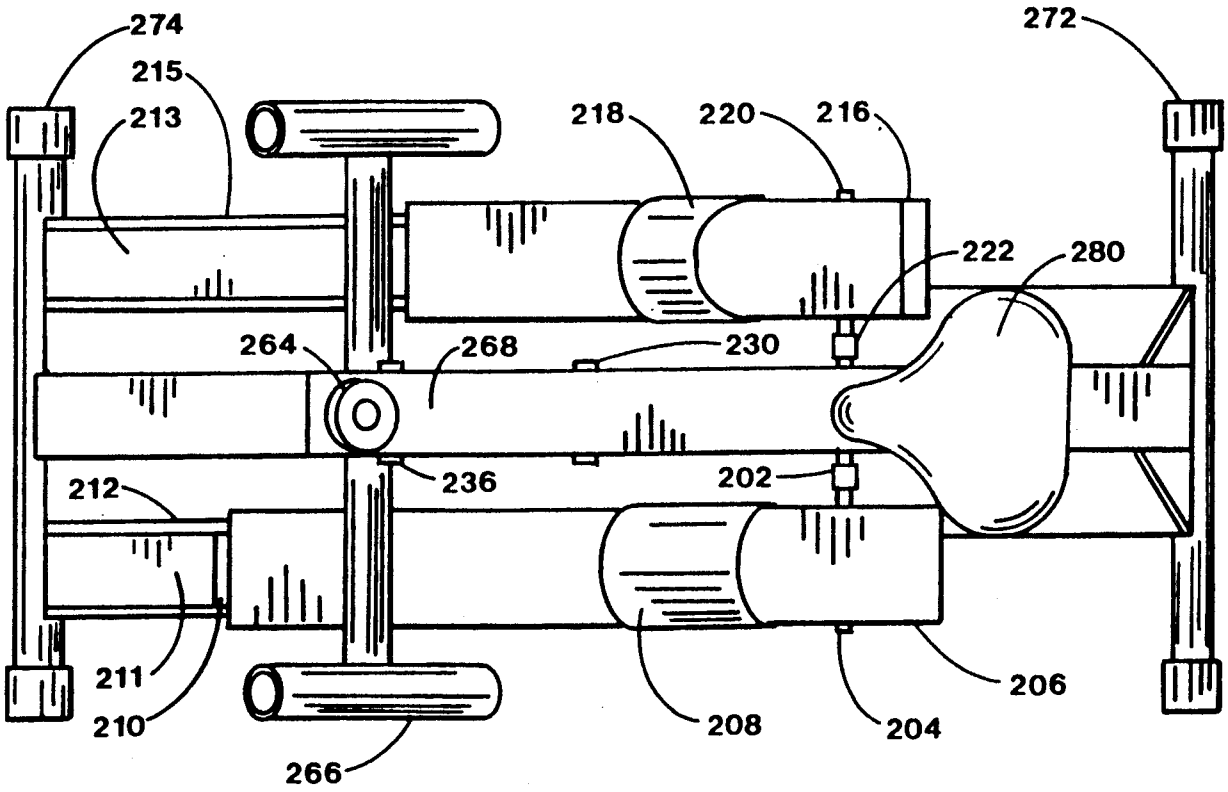
FIG. 9 is a top view of the alternate embodiment shown in FIG. 8.

An alternate embodiment is shown in FIGS. 8 and 9 where the rocker links of the preferred embodiment are replaced with sliding tracks 211 and 213 contained in track support members 212 and 215. Track supports 212 and 215 are shown parallel to base 270 can be raised or inclined to vary the pedal platform motion. Pedal platforms 206 and 216 are supported at one end by rollers 210 and 214 which ride in tracks 211 and 213 and by bearing journals 204 and 220 attached to rotary cranks 202 and 222 which are joined at bearing journal 200 fixed to frame 268 and phased approximately 180 degrees apart. The rotary crank 202, pedal platform 206, roller 210 and track 211 form a mechanism known in the literature as a slider crank. The slider crank shown in FIG. 8 provides pedal positions closely approximating the ideal positions shown in FIG. 2. Foot straps 208 and 218 are attached to the pedal platforms 206 and 216 where the user desires using alternate fasteners 207. A higher knee lift occurs with the feet near bearing journals 204 and 220 while a reduced lift occurs as the foot straps are placed near the rollers 210 and 214.

The support structure has base 270 parallel to and raised above the floor supported by pads 272 and 274. Track supports 212 and 215 are secured to base 270 as are vertically inclined tubular frame supports 267 and 268 also joined at their intersection. Handle 266 provides hand support during operation. Seat 280 is attached to tube 278 which telescopes into a tubular part of the frame 276. Stand-up or sit-down cycling is an option to the user with all the pedal platform controls taught by this invention. The load resistance for this embodiment was chosen to be friction band 242 wrapped around flywheel 240 rotatably mounted to frame member 235 by bearing journal 236. One end of the friction band 242 is attached to the frame 267 through load spring 244 and eyelets 243 and 246. The other end of the friction band 242 is attached to load spring 254 by cable 250 through eyelets 248 and 252. The spring load 254 is adjusted by a turn of the handle 264 through threaded rod 262, slider 260 and cable 258 attached to spring eyelet 256.

The flywheel 240 is driven by sprocket 238 through chain 234 connected to larger sprocket 232. Sprocket 232 shares journal 230 with a smaller sprocket 228 which communicates with drive sprocket 224 through chain 226. Sprocket 224 is driven by rotary crank journal 200 through a conventional one-way clutch 201. As a user rotates the cranks 202 and 222, the two stage speed up sprocket pairs rotate the flywheel at about a 10:1 speed up ratio for kinetic energy storage as part of the load resistance and to pull the pedal platforms through the dead center positions. It is understood that other forms of load resistance such as phased drag pulleys can be used with slider crank pedal platform control.

Figure 10:
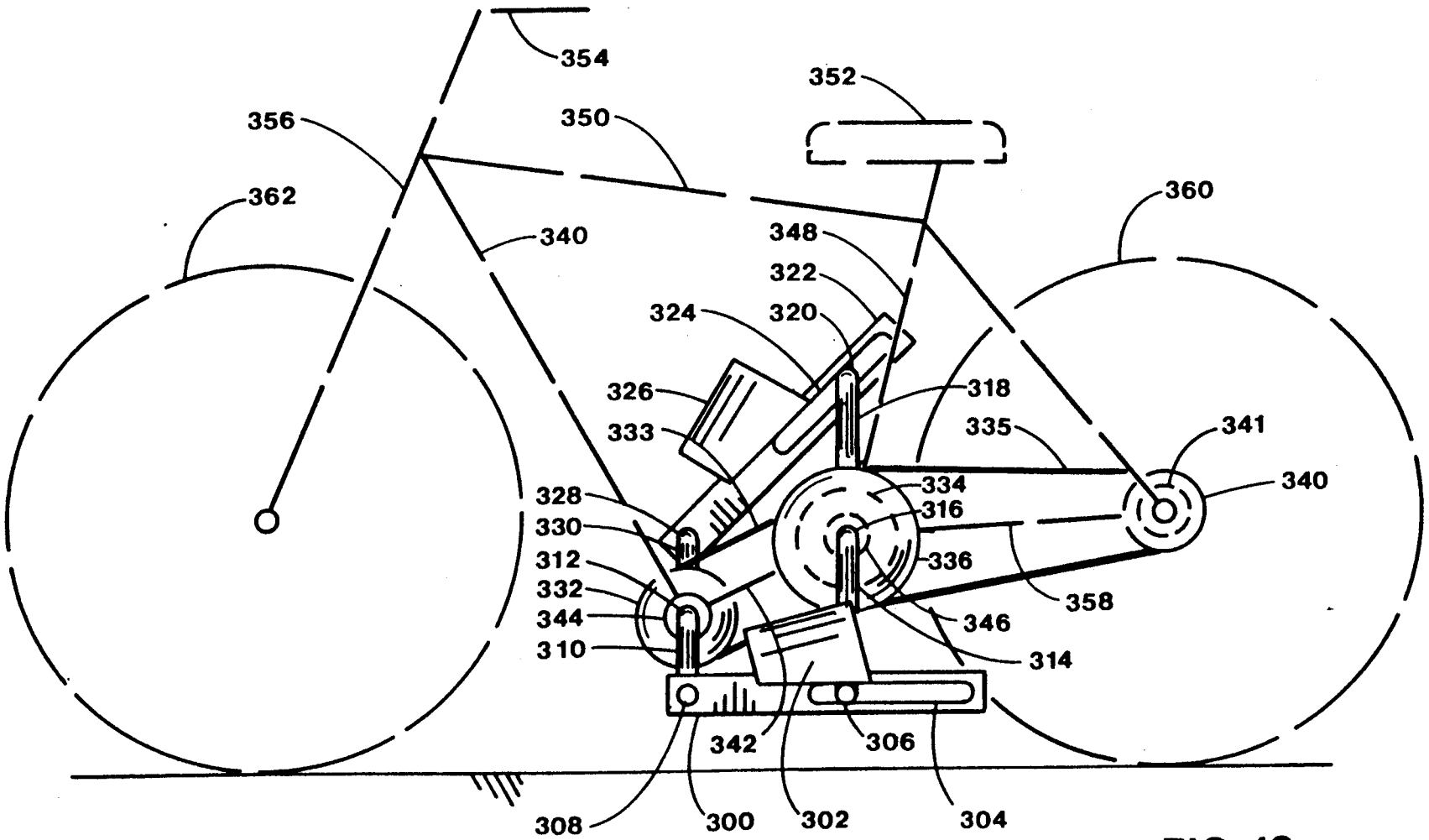
FIG. 10 is an alternate embodiment of the present invention which shows a five-bar geared linkage for pedal platform motion control applied to the propulsion system of a bicycle.
Figure 11:
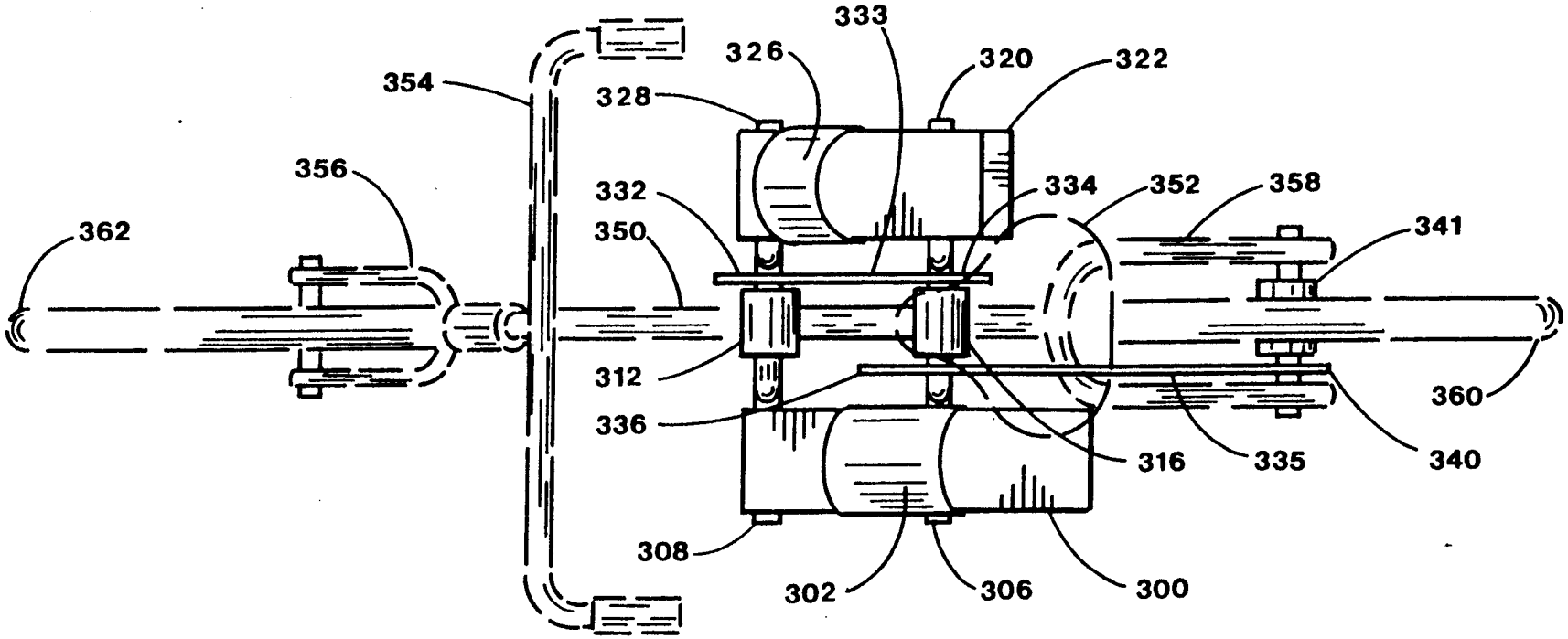
FIG. 11 is a top view of the embodiment shown in FIG. 10.

Another embodiment of pedal platform control is shown in FIGS. 10 and 11 as the propulsion system of a bicycle due to the compactness of the five-bar mechanism controlling the pedal platforms 300 and 322. A relatively standard bicycle is shown with tubular framework (356,340,350,358), seat 352 and handlebar 354. Rear wheel 360 is driven by sprockets 336, 340, chain 335 and one-way clutch 341. Not shown is a means to change the speed ratio. The main rotary cranks 314 and 318 drive sprocket 336 through bearing journal 316 rotatably attached to frame 348. At this point, a departure is made from the conventional bicycle because pedal journals 306 and 320 do not have free pedals but are constrained to slide in tracks 304 and 324 contained in pedal platforms 300 and 322 having foot straps 302 and 326. A second crank pair 310,330 is attached to the pedal platforms 300 and 322 by bearings 308 and 328. Rotary cranks 310 and 330 are connected 180 degrees apart by bearing journal 312 which is pivotally attached to frame 340. Also attached to crank journal 312 is sprocket 332 connected to another sprocket 334 of equal diameter by chain 333. Sprocket 334 is attached to rotate with main crank journal 316. Cranks 318,330 and 310,314 each completes one full revolution per cycle moving with parallel motion. Crank pair 318,330 is longer than crank pair 310,314 with a 2:1 length ratio being preferred. The rotary crank journals 312 and 316 are located on the frame 340, 358 to position pedal platform 300 parallel to the ground when the leg is fully extended. It should be obvious that the five-bar pedal platform control mechanism is easily adapted to any stationary cycling apparatus where the bicycle is shown in exemplify the diverse application of pedal platform control.

Figure 12:
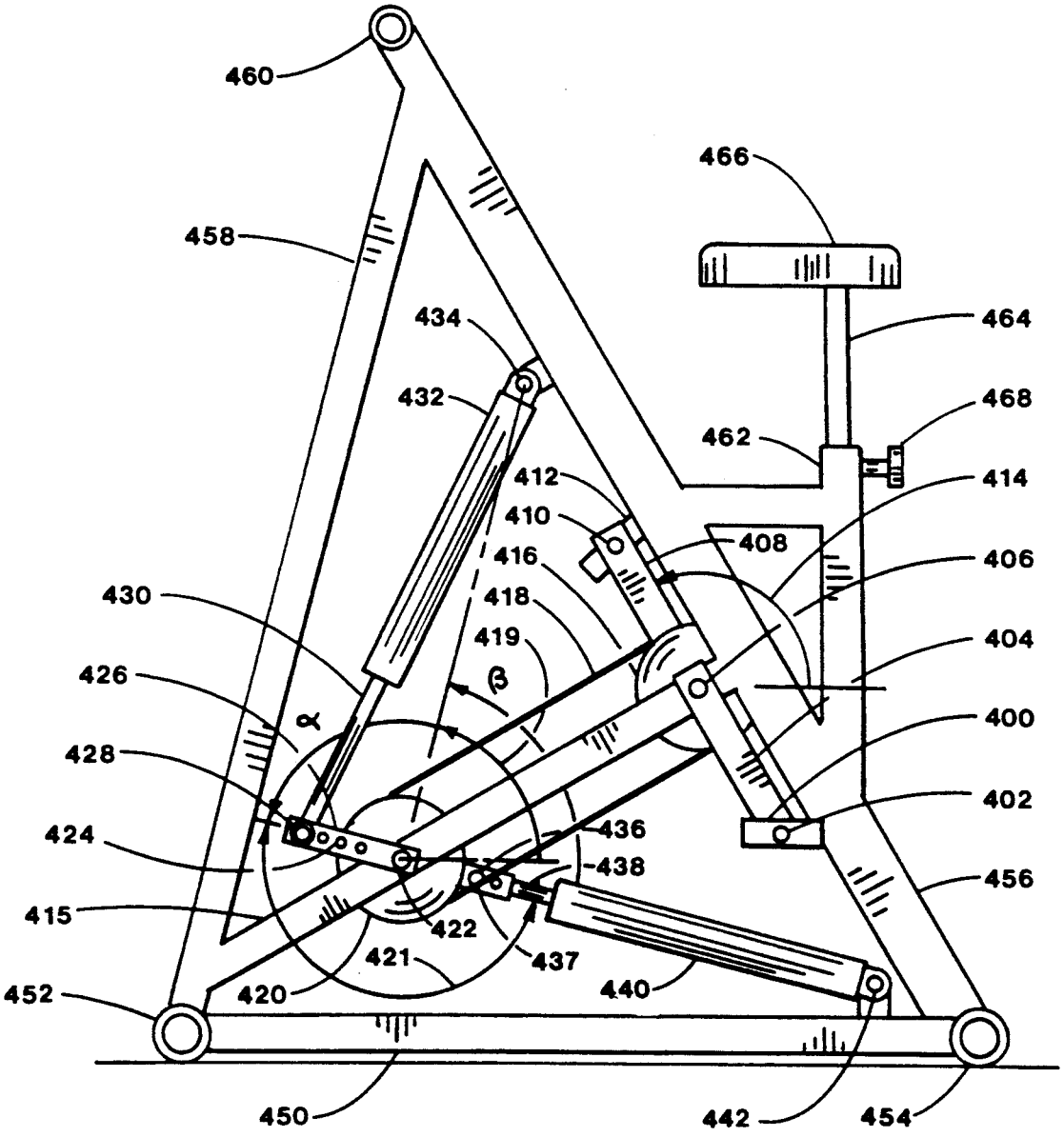
FIG. 12 is a left side view of an alternate embodiment of phased load resistance using viscous cylinder loading.

Another embodiment of phased load resistance is shown in FIG. 12 where two viscous linear cylinders 440 and 432 are positioned relative to rotary cranks 426 and 436 to provide a high intensity primary load resistance and a lower intensity load resistance during dead center crank positions. A framework to support the apparatus has base 450 with floor supports 452 and 454, inclined tubular vertical members 456 and 458, cross member 415, handlebar 460 and seat support 462. Seat 466 is adjustable by virtue of handle 468 and telescoping support 464. Foot pedals 400 and 412 are shown free to rotate on pedal bearing journals 402 and 410. It is understood that any of the other pedal platform control mechanisms taught by this invention can be used in place of rotary free pedals. Rotary pedal cranks 404 and 408 are connected through bearing journal 406 pivotally attached to frame member 415. Also attached to bearing journal 406 is sprocket 416 which is connected to an equal size sprocket 420 through chain 418. Of course, a timing belt and equal pulleys or two equal gears with an idler gears connecting them can also be used to maintain a phase relationship between the two crank systems. Sprocket 420 is attached to cranks 426 and 436 through bearing journal 422 pivotally mounted to frame member 415. Viscous cylinder 432 is pivotally attached to frame 456 at 434 and to crank 426 at bearing 428 through cylinder rod 430 as a primary load resistance. A second viscous cylinder 440 is pivotally attached to frame 450 at mounting 442 and at crank 436 through bearing 437 and cylinder rod 438. Viscous loading or damping is defined here to mean a fluid including air which is forced through an orifice such that the linear load required to move a cylinder rod is proportional to the velocity of the cylinder rod 430 or 438. The cylinders 432 and 440 shown here are double acting where load resistance occurs in either direction of cylinder rods 430 and 438. Of course, single acting cylinders could be used with the addition of another pair properly positioned. Load resistance adjustment is achieved with separate adjustable orifices for each cylinder; or an orifice system common to the fluid of both cylinders; or by relocating the cylinder rod pivot 428 or 437 to one of the other location holes 424 on cranks 426 and 436. The crank 426 length or radius arm is shown in FIG. 12 to be longer than crank 436 radius arm as an option. Primary load cylinder rod 430 is shown in a near maximum velocity and load condition while secondary load cylinder rod 438 is in a minimum load position. Conversely, when the primary load cylinder is at a minimum, the secondary load cylinder is near a maximum load. Normally the secondary load resistance is of a lower intensity to aid the pedal cranks 404 and 408 through the dead center positions. It should be understood that equal load resistance in both the primary and secondary cylinders can be phased to provide a nearly continuous torque on the pedal cranks 404 and 408.

EXAMPLE 1—PEDAL POSITION CONTROL

Referring to FIG. 2, the ideal position angles can be measured from the horizontal as angle $\psi$ which is listed in TABLE 1. The angles $\psi$ achieved by the crank-rocker mechanism shown in FIG. 3 with pivot to pivot dimensions:

Crank 72=9.0" Coupler 76=19.5"
Coupler triangle sides 86=18.0" and 88*a*=12.0"
Rocker 80=28.0" Base link 84=30.0"

are listed in TABLE 1 for comparison. The greatest variation from the ideal occurs when $\Delta\psi$=13 degrees at positions c and g. It has been found that the ankle joint can accommodate a foot rotation of 13 degrees in dorsiflexion or plantar flexion without raising the heel from the pedal platform. It is understood that sophisticated computer synthesis software could produce design parameters with an even smaller $\Delta\psi$.

TABLE 1

| | DEGREES | | |
|---|---|---|---|
| Position | Ideal Angle $\psi$ | Generated $\psi$ | $\Delta\psi$ |
| a | 33 | 34 | 1 |

TABLE 1-continued

| Position | Ideal Angle ψ (DEGREES) | Generated ψ (DEGREES) | Δψ (DEGREES) |
|---|---|---|---|
| b | 18 | 10 | 8 |
| c | 10 | −3 | 13 |
| d | 0 | 0 | 0 |
| e | 27 | 20 | 7 |
| f | 50 | 39 | 11 |
| g | 61 | 48 | 13 |
| h | 52 | 46 | 6 |

EXAMPLE 2—PHASED DRAG PULLEY LOAD RESISTANCE

Referring to FIGS. 4, 6 and 7, the primary torque T1 acting on rotary cranks 72 and 92 located by angle $\theta$ is $T1 = FL * SL + FR * SR$ where $LL$ = length (113.74) = $\sqrt{r^2 + z^2 - 2*z*r*cos(\theta)}$ $LR$ = length (109.94) = $\sqrt{r^2 + z^2 + 2*z*r*cos(\theta)}$ $SL$ = perpendicular distance from (70.113) to 74 = $z*r*\sin(\theta)/LL$ $SR$ = perpendicular distance from (113.70) to 94 = $-z*r*\sin(\theta)/LR$ $X$ = spring 126 deflection = $(E - LL - LR)/2$ $FN = K(X\max - X) + P$ = spring 126 force $FL = .86FN$ = force in cable length $LL$. $0 < \theta < 180°$ $FR = .276FN$ = force in cable length $LR$. $0 < \theta < 180°$ $r$ = crank length (70.74) = (70.94) = 9.0"

$z$ = length (70.113) = 13.0"

$E$ = total cable 112 length = 40.0

$K$ = spring 126 constant = 50.0 lbs/in.

$P$ = initial spring 126 load = 50.0 lbs/in.

Figure 13:
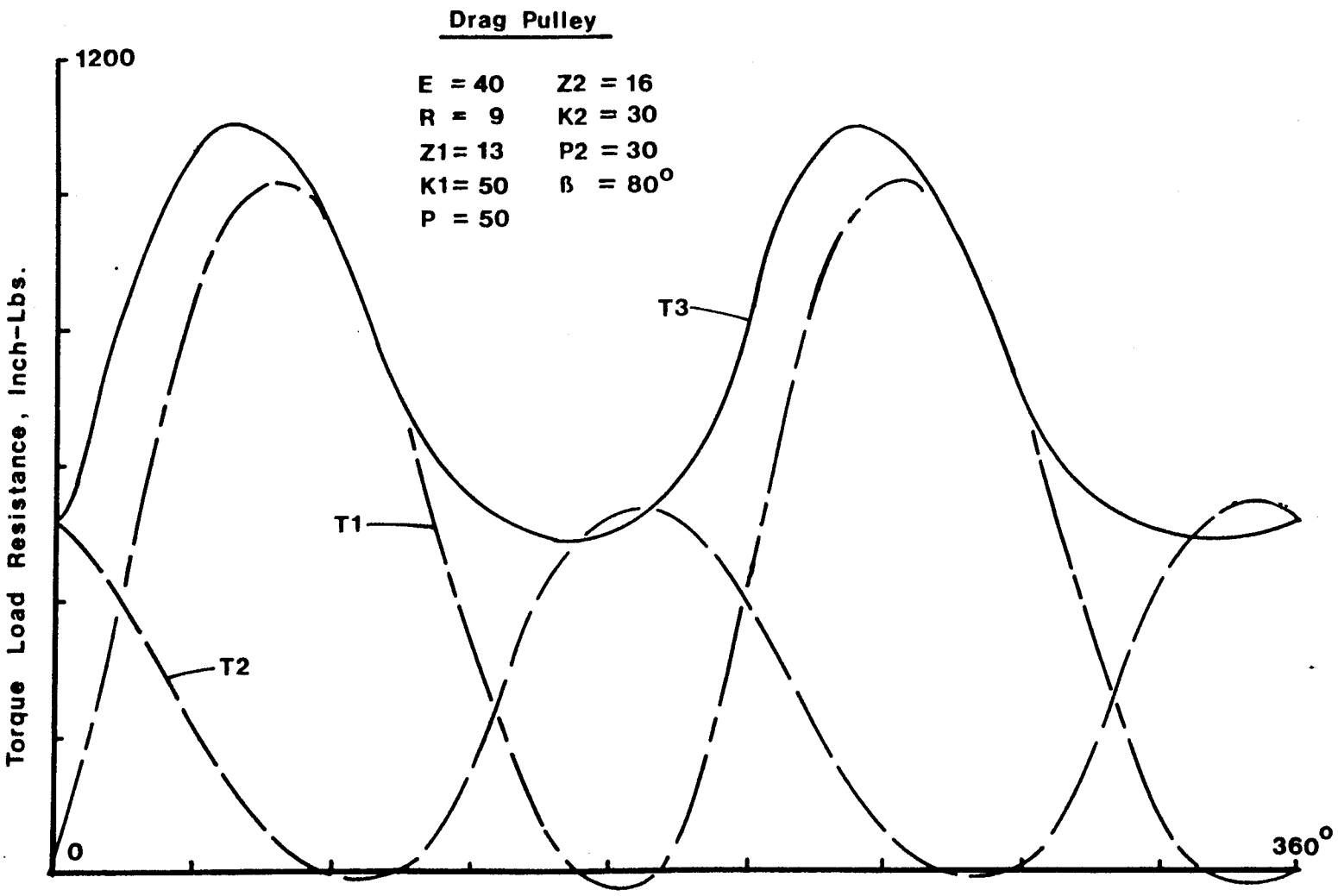
FIG. 13 is a graph of rotary crank torque load versus angular position of the crank for the preferred embodiment using the phased drag pulley load resistance shown in FIG. 4.

$X\max = (E - 2z)/2$ at $\theta = 0$ degrees $\gamma$ = offset angle to pulley 113 = 30 degrees The resulting primary torque T1 is shown in FIG. 13 as a nearly pure simple harmonic loading on rotary cranks 72 and 92.

Similar equations can be used to determine the secondary torque loading T2 on cranks 72 and 92. For additional values K2 = spring 152 constant = 30.0 lbs/in.
P2 = initial spring 152 preload = 30.0 lbs/in.
$\beta$ = phase angle between cable turn arounds 113 and 140 = 80 degrees the secondary torque T2 is shown in FIG. 13 as simple harmonic loading where the peak loading is approximately one half of the peak primary loading. The total torque T3 acting upon the pedal platforms 88 and 90 is the sum of T1 and T2. T3 is a smoothly varying load resistance where the peak occurs at $\theta = 60$ degrees with rotary cranks 72 and 92 about horizontal and minimum load at $\theta = 160$ degrees which is approximately the dead center position.

EXAMPLE 3—VISCOUS LOAD RESISTANCE

Referring to FIG. 12, the torque T1 acting on crank journal 422 due to load cylinder 432 is given to be proportional to the velocity of cylinder rod 430 as $$T1 = \frac{C1*R1^2*Z1^2*\sin^2(\alpha)}{R1^2 + Z1^2 - 2*Z1*R1*\cos(\alpha)}$$

where $C1$ = viscous constant of cylinder 432 = 5

$R1$ = crank (428.422) = 5.0"

$Z1$ = length (422.434) = 24.0"

$\alpha$ = angle locating crank $R$

Figure 14:
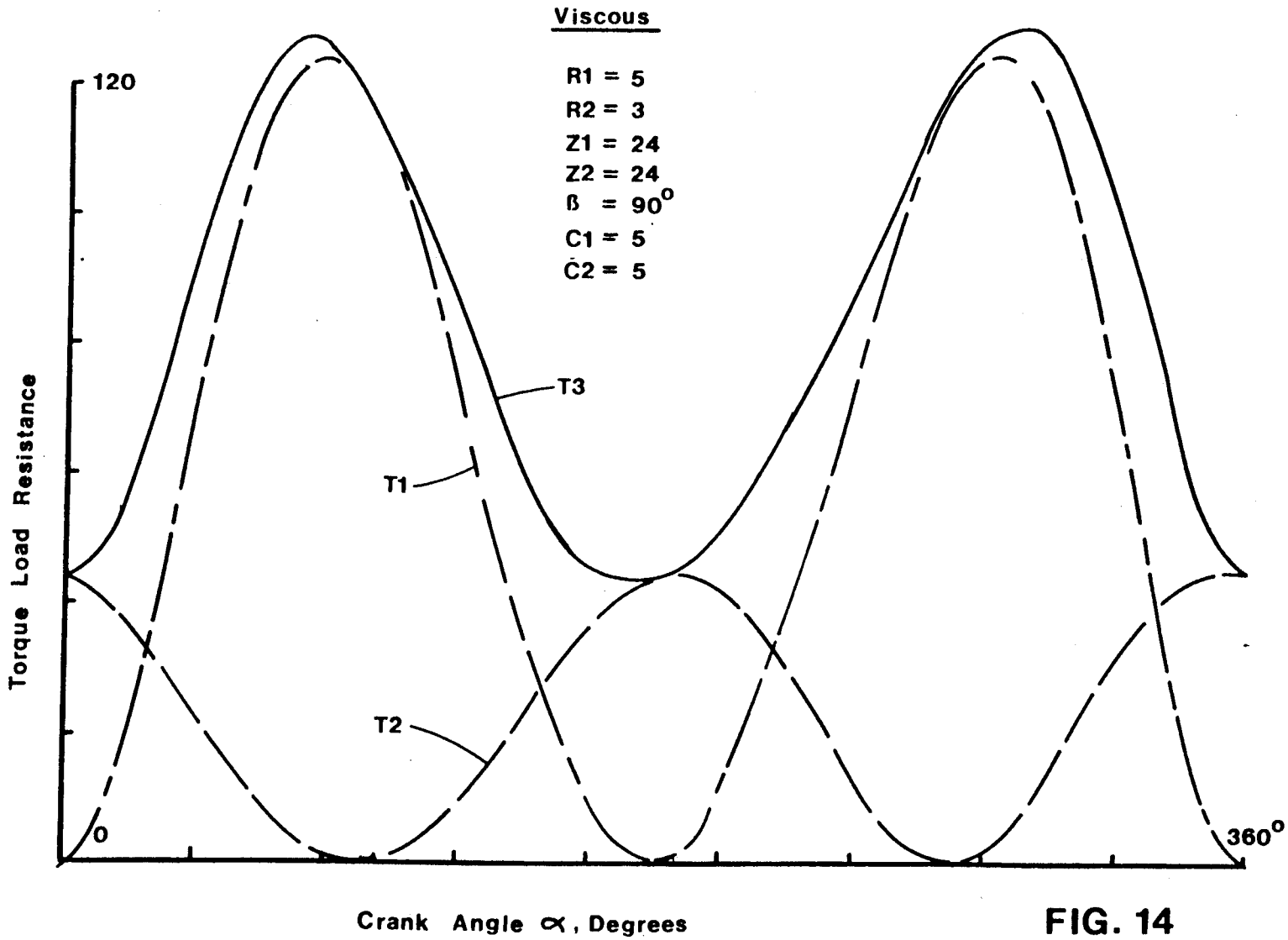
FIG. 14 is a graph of rotary crank torque load versus angular position of the crank for the alternate embodiment of phased viscous cylinder load resistance shown in FIG. 12.

The primary load T1 is shown in FIG. 14 as a smooth simple harmonic curve.

The secondary load resistance torque T2 acting on crank 437 due to load cylinder 440 is proportional to the velocity of cylinder rod 438 as $$T2 = \frac{C2*R2^2*Z2^2*\sin^2(\alpha + \beta)}{R2^2 + Z2^2 - 2*Z2*R2*\cos(\alpha + \beta)}$$

where $C2$ = viscous constant of cylinder 440 = 5

$R2$ = crank length (437.422) = 3.0"

$Z2$ = length (422.442) = 24.0"

$\beta$ = phase angle between $Z1$ and $Z2$ = 90 degrees

The secondary load T2 is shown in FIG. 14 as a smooth simple harmonic curve where the peak is about ⅓ of the primary torque T1. The combined torque T3 is the sum of T1 and T2 acting on cranks 426 and 436 at bearing journal 422 is a smoothly varying torque load resistance with a 3/1 load variation. The angles 414 and 419 are chosen to phase the minimum T3 during the dead center positions which can differ depending on whether the user is standing, prone, vertical or recumbent seated. A smoothly varying load resistance is given to pedal cranks 404 and 408 which increases with the speed of the user action.

What is claimed is:

1. An exercise apparatus that simulates uphill cycling where the user maintains a preferred standing posture comprising: an elongated base means adapted to rest upon a substantially flat surface, a pedal platform support means connected to said base means, an elongated pedal platform means to support the foot of the user, a linkage means connected to said pedal platform means and said pedal platform support means to cause said pedal platform means to move from a position substantially horizontal to said base means in a translating and non-parallel angular motion 360 degrees back to the starting substantially horizontal position to maintain the heel of the foot of the user substantially parallel to the said pedal platform means wherein the pedal platform means move in a pedal cycle as substantially shown in FIG. 2.

2. The exercise apparatus of claim 1 wherein said linkage means includes said pedal platform means as part of a four-bar linkage motion to return the pedal platform means to the horizontal position.

3. The exercise apparatus of claim 1 wherein said linkage means includes said pedal platform means as part of the coupler link of a four-bar linkage crank-rocker mechanism.

4. The exercise apparatus of claim 3 wherein said linkage means includes a load resistance means operably associated therewith to place an adjustable load on said four-bar linkage crank-rocker mechanism to allow the user to adjust the load according to the user's demand.

5. The pedal platform means and pedal platform support means of claim 1 where the said pedal platform means is a part of the coupler link of a four-bar linkage slider-crank mechanism such that the said four-bar linkage slider-crank mechanism becomes the said pedal platform support means having a rotary crank rotatably attached to said framework and a linear or non-linear curved track adjustably attached to said framework to guide a translating element.

6. The pedal platform means and pedal platform support means of claim 1 where the said pedal platform means is a part of the coupler link of a five-bar linkage geared mechanism whereby the said five-bar linkage geared mechanism becomes the said pedal platform support means having two rotary cranks rotatably attached to said framework and said rotary cranks are coupled to rotate with parallel crank motion.

7. The pedal platform means and pedal platform support means of claim 1 where the said pedal platform means is a part of the coupler link of a five-bar linkage geared mechanism such that the said five-bar linkage geared mechanism becomes the said pedal platform support means having two rotary cranks rotatably attached to the framework of a bicycle or other land vehicle whereby said rotary cranks are coupled to rotate with parallel crank motion and become the propulsion means of said land vehicle.

8. The pedal platform means and pedal platform support means of claim 1 where said pedal platform means remains in contact with both the heel and toe of the foot throughout the said pedal cycle such that the pedal platform angle changes by at least five degrees during the pedal cycle.

9. The pedal platform means and pedal platform support means of claim 1 where said pedal platform means follows a programmed angular motion throughout one full pedal cycle in either direction of rotation of said angular motion.

10. The pedal platform means and pedal platform support means of claim 1 where said pedal platform means has foot straps adjustably attached to said pedal platform means whereby said foot strap adjustment allows the user to select the stroke length between dead center positions of said pedal platform support means.

11. The pedal platform means and pedal platform support means of claim 1 where said pedal platform support means includes a rotary crank pair providing part of the pedal platform constraint having the said rotary crank pair coupled by a bearing journal rotatably fixed to said framework and said rotary crank pair phased by 120 to 240 degrees apart with the preferred phase angle being substantially 180 degrees.

12. The pedal platform means and pedal platform support means of claim 1 where said pedal platform support means includes a rotary crank rotatably attached to said framework that is coupled through a one-way clutch to a flywheel means attached to said framework such that said flywheel means has a load resistance means attached to said framework and operably associated with said flywheel means to increase the torque required to sustain rotation of said rotary crank.

13. The pedal platform means and pedal platform support means of claim 1 where said pedal platform support means is coupled to a load resistance means attached to said framework comprising a rotary crank of constant or variable length as part of the said pedal platform support means, said pedal platform means attached to said rotary crank, a flexible linking means pivotally attached to said rotary crank, a drag pulley means and drag pulley support means attached to said framework where said drag pulley means are connected by said flexible linking means, and a force loading means adjustably attached to said framework and drag pulley support means where said force loading means supplies tension to said flexible linking means whereby said exercise apparatus operates with phased simple harmonic torque load resistance acting upon the said rotary crank.

14. An exercise apparatus that simulates uphill cycling where the user maintains a preferred standing posture comprising: an elongated base means adapted to rest upon a substantially flat surface, a pedal platform support means connected to said base means, an elongated pedal platform means to support the foot of the user, a linkage means connected to said pedal platform means and said pedal platform support means to cause said pedal platform means to move from a position substantially horizontal to said base means in a translating and non-parallel angular motion 360 degrees back to the starting substantially horizontal position to maintain the heel of the foot of the user substantially parallel to said pedal platform means; wherein said linkage means includes said pedal platform means as part of the coupler link of a four-bar linkage crank-rocker mechanism.

* * * * *